US007753167B2

(12) United States Patent
Fukano et al.

(10) Patent No.: US 7,753,167 B2
(45) Date of Patent: Jul. 13, 2010

(54) SILENCER

(75) Inventors: Yoshihiro Fukano, Moriya (JP); Shoichi Makado, Moriya (JP)

(73) Assignee: SMC Kabushiki Kaisha, Tokyo (JP)

( * ) Notice: Subject to any disclaimer, the term of this patent is extended or adjusted under 35 U.S.C. 154(b) by 339 days.

(21) Appl. No.: 11/813,277

(22) PCT Filed: Jan. 12, 2006

(86) PCT No.: PCT/JP2006/000310

§ 371 (c)(1),
(2), (4) Date: Jul. 2, 2007

(87) PCT Pub. No.: WO2006/075670

PCT Pub. Date: Jul. 20, 2006

(65) Prior Publication Data

US 2009/0266643 A1 Oct. 29, 2009

(30) Foreign Application Priority Data

Jan. 13, 2005 (JP) ..... 2005-006759

(51) Int. Cl.
*F01N 1/08* (2006.01)
*F01N 1/24* (2006.01)
*G10K 13/00* (2006.01)

(52) U.S. Cl. ..... 181/230; 181/158; 181/256; 181/257; 181/258; 181/267

(58) Field of Classification Search ..... 181/158, 181/230, 256, 257, 258, 267
See application file for complete search history.

(56) References Cited

U.S. PATENT DOCUMENTS 2,600,236 A * 6/1952 Gibel ..... 181/257
2,815,088 A * 12/1957 Gibel ..... 181/230
2,886,121 A * 5/1959 Welbourn ..... 181/225
3,073,684 A * 1/1963 Williams, Sr. ..... 422/175
3,380,553 A * 4/1968 Gibel ..... 181/230
3,688,870 A * 9/1972 Gibel et al. ..... 181/267
3,718,208 A * 2/1973 Gibel ..... 181/267
3,776,365 A * 12/1973 Richards ..... 181/256
3,898,063 A * 8/1975 Gazan ..... 96/384
4,082,160 A * 4/1978 Schilling et al. ..... 181/258
4,316,523 A * 2/1982 Boretti ..... 181/226
4,375,841 A * 3/1983 Vielbig ..... 181/272

(Continued)

FOREIGN PATENT DOCUMENTS

JP 51-139301 12/1976

(Continued)

*Primary Examiner*—Jeffrey Donels
*Assistant Examiner*—Christina Russell
(74) *Attorney, Agent, or Firm*—Paul A. Guss

(57) ABSTRACT

A silencer includes a cylindrical member held between a body connected to an exhaust side of a fluid pressure device and a disk-shaped retaining member. A net-shaped sound absorber is disposed around an outer circumference of the cylindrical member. A pressure fluid flows from the body into the interior of the cylindrical member and is discharged toward the sound absorber through a plurality of first through fifth exhaust holes formed in the cylindrical member. Accordingly, dust in the pressure fluid is removed by the sound absorber, which is formed of a plurality of stacked filters, and further, the pressure fluid is discharged to the outside after exhaust noises have been absorbed by the sound absorber.

10 Claims, 4 Drawing Sheets

U.S. PATENT DOCUMENTS

| | | | | | |
|---|---|---|---|---|---|
| 4,497,388 | A | * | 2/1985 | Dexter | 181/233 |
| 4,617,963 | A | * | 10/1986 | Stares | 137/625.3 |
| 4,646,660 | A | * | 3/1987 | Bjorkman et al. | 110/210 |
| 4,913,260 | A | * | 4/1990 | Fallon | 181/254 |
| 5,199,537 | A | * | 4/1993 | Worner et al. | 188/266 |
| 5,213,136 | A | * | 5/1993 | Thorp et al. | 137/625.68 |
| 5,355,765 | A | * | 10/1994 | Rogers | 89/14.4 |
| 5,574,264 | A | | 11/1996 | Takemori et al. | |
| 5,767,459 | A | * | 6/1998 | Sell | 181/258 |
| 5,962,821 | A | * | 10/1999 | Iannetti | 181/256 |
| 6,109,387 | A | * | 8/2000 | Boretti | 181/230 |
| 6,209,678 | B1 | * | 4/2001 | Sterling | 181/230 |
| 6,668,971 | B2 | * | 12/2003 | Sterling | 181/230 |
| 6,739,426 | B2 | * | 5/2004 | Sherikar et al. | 181/248 |
| 2005/0023075 | A1 | * | 2/2005 | Schmaeman | 181/233 |

FOREIGN PATENT DOCUMENTS

| | | |
|---|---|---|
| JP | 51-155477 | 12/1976 |
| JP | 55-130247 | 9/1980 |
| JP | 56-087666 | 7/1981 |
| JP | 60-137111 | 9/1985 |
| JP | 61-162585 | 10/1986 |
| JP | 61-200407 | 12/1986 |
| JP | 7-14114 | 3/1995 |
| JP | 7-229415 | 8/1995 |
| JP | 08-170518 | 7/1996 |
| JP | 9-41947 | 2/1997 |
| JP | 11-350952 | 12/1999 |
| JP | 2000-110726 | 4/2000 |
| JP | 2001-289167 | 10/2001 |
| JP | 2002-047911 | 2/2002 |
| JP | 2002-257664 | 9/2002 |
| KR | 20-0174862 | 1/2000 |

* cited by examiner

SILENCER

TECHNICAL FIELD

The present invention relates to a silencer for minimizing exhaust noises produced when a pressure fluid is exhausted from a fluid pressure device.

BACKGROUND ART

Heretofore, for example, when a pressure fluid is exhausted from a fluid pressure device such as a valve or the like, exhaust noises tend to be generated, and therefore, a silencer has been disposed at the exhaust side of the fluid pressure device for minimizing such exhaust noises.

In such a silencer, as disclosed in Japanese Laid-Open Patent Publication No. 2001-289167, a cylindrically shaped filter is provided for removing moisture, dust and the like contained within the pressure fluid exhausted from the fluid pressure device, as well as for reducing exhaust noises, wherein both ends of the filter are retained respectively. In addition, by causing the pressure fluid that is exhausted from the fluid pressure device to be exhausted to the outside through the filter, exhaust noises of the pressure fluid device are reduced, and moreover, dust and the like contained within the pressure fluid is removed.

However, in the aforementioned silencer, when the pressure fluid is caused to flow toward the silencer from the fluid pressure device, the pressure drops precipitously in the vicinity of a connection part between the silencer and the fluid pressure device where the pressure fluid is released to atmosphere, and further, the temperature inside the silencer drops as a result of adiabatic expansion of the pressure fluid. Accordingly, owing to the reduction in temperature, moisture that is contained within the pressure fluid condenses in the vicinity of the connection part, and at the reduced temperature, such condensation becomes frozen at the interior of the silencer, resulting in a concern that operations of the fluid pressure device connected to the silencer may be adversely affected.

Further, in the case that the filtering capability of the filter is raised, with the aim of further reducing pressure fluid exhaust noises, clogging can easily be generated as a result of dust contained within the pressure fluid, with the problem that a desired noise reduction effect may not be obtainable.

DISCLOSURE OF THE INVENTION

A principal object of the present invention is to provide a silencer, which is capable of suppressing generation of clogging, while causing a reduction in exhaust noises, along with preventing the occurrence of condensation when the pressure fluid is exhausted.

According to the present invention, a silencer for causing a reduction in exhaust noises of a pressure fluid exhausted from a fluid pressure device comprises a main body portion to which the fluid pressure device is connected and to which a pressure fluid from the fluid pressure device is introduced, a sound absorber retained within the main body portion and formed of filters made up of plural stacked layers having different opening areas, and a flow adjustment mechanism for gradually increasing a flow amount of the pressure fluid exhausted to the outside from the main body portion through the sound absorber in a direction separating away from the fluid pressure device. It is preferable for the opening areas of the filters to be set so as to become gradually smaller directed from an upstream side formed at a side of the main body portion toward a downstream side formed at an exterior side of the sound absorber.

Further, the sound absorber preferably is constructed by stacking plural filters having different opening areas, wherein the upstream side formed at the side of the main body portion has a larger opening area, and conversely, the downstream side formed at the exterior side of the sound absorber has a smaller opening area.

In addition, the flow adjustment mechanism preferably includes a fluid passage for enabling a pressure fluid to flow from the main body portion to the exterior of the sound absorber, wherein a passage area of the fluid passage is formed so as to become gradually larger in a direction separating away from the fluid pressure device.

Still further, it is preferable for the fluid passage to be formed from a cylindrical body disposed inside the sound absorber and communicating with the main body portion, having a plurality of exhaust holes that become gradually greater in quantity in a direction separating away from the fluid pressure device.

Still further, it is preferable for a clearance to be disposed between the cylindrical body and the sound absorber.

Further, the filters preferably are constructed from three layers, which are stacked radially.

Furthermore, it is preferable for the filters to have respective thickness dimensions in the radial direction that are substantially uniform.

Still further, it is preferable for a cylindrical cover member that surrounds the sound absorber to be connected to the main body portion, wherein the cover member has holes therein through which the pressure fluid that flows through the sound absorber also flows.

Further, in addition, the flow adjustment mechanism preferably comprises filters having thickness dimensions becoming gradually smaller in a direction separating away from the fluid pressure device.

Further, it is preferred that a detection mechanism be provided in the main body portion for detecting a case in which the pressure of the pressure fluid inside the main body portion rises to a predetermined value or above.

Moreover, it is preferable that the detection mechanism comprises a passage disposed in the main body portion communicating an interior of the main body portion with the outside, a valve seated on a valve seat formed in the passage, and a spring for pressing the valve toward the valve seat.

BEST MODE FOR CARRYING OUT THE PRESENT INVENTION

Figure 1:
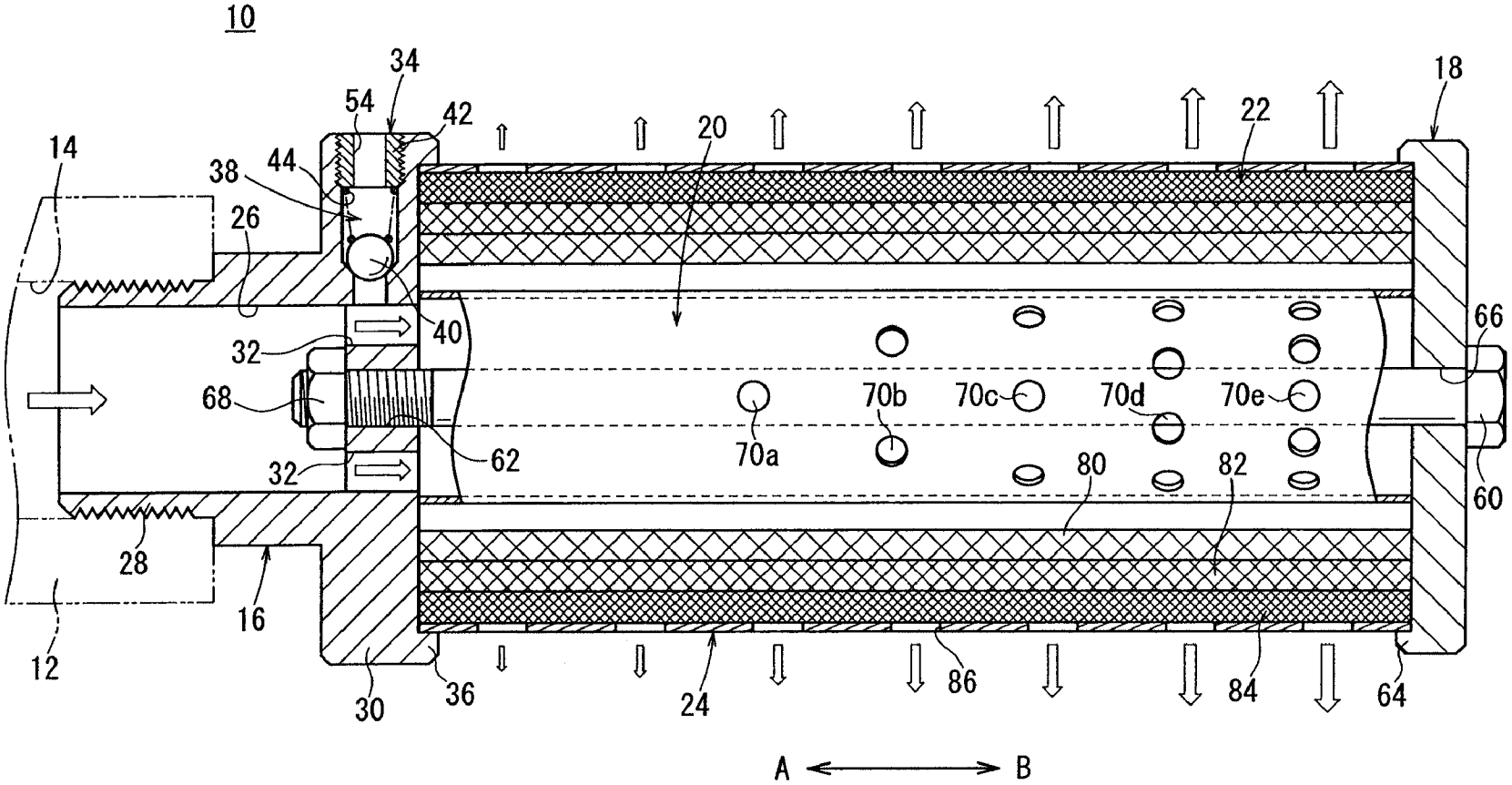
FIG. 1 is a vertical sectional view of a silencer according to a first embodiment of the present invention.

In FIG. 1, reference numeral 10 indicates a silencer according to a first embodiment of the present invention.

The silencer 10 includes a body (main body portion) 16 connected to an exhaust port 14 of a fluid pressure device 12 (for example a solenoid valve), a retaining member 18 disposed coaxially with and separated a predetermined interval away from the body 16, a cylindrical member (cylindrical body) 20 sandwiched between the body 16 and the retaining member 18, a sound absorber 22 disposed on an outer circumferential side of the cylindrical member 20 for reducing exhaust noises of a pressure fluid that is discharged from the fluid pressure device 12, and a cylindrically shaped cover member 24 disposed on the outer circumference of the sound absorber 22.

The body 16 is equipped with a connecting portion 28 through which a pressure fluid flows via a penetrating hole 26 formed in the interior thereof, a diametrically expanded portion 30 that expands radially outward with respect to the connecting portion 28 and which retains an end of the sound absorber 22 and the cylindrical member 20 therein, a plurality of communication holes 32 formed in an inner circumferential side of the diametrically expanded portion 30 that face the penetrating hole 26 of the connecting portion 28, and a detector (detection mechanism) 34 that detects fluctuations in pressure inside the body 16.

The connecting portion 28 is formed on one end side (in the direction of the arrow A) of the body 16 and is connected to the exhaust port 14 through which the pressure fluid in the fluid pressure device 12, for example a solenoid, is exhausted. Further, the pressure fluid is introduced into the penetrating hole 26 of the connecting portion 28 from the exhaust port 14. The connecting portion 28, however, is not limited to being directly connected to the exhaust port 14 of the fluid pressure device 12, but may also be connected with the exhaust port 14 through piping or the like.

The diametrically expanded portion 30 is formed at the other end side (in the direction of the arrow B) of the body 16, wherein a first projection 36, projecting in a direction (the direction of the arrow B) away from the connecting portion 28, is formed on the outer peripheral end face thereof. The first projection 36 is formed in an annular shape extending from the outer peripheral face of the diametrically expanded portion 30 toward the sound absorber 22.

Further, the detector 34, which detects when a pressure of the pressure fluid that flows through the body 16 exceeds a predetermined value (preset value), is disposed within the diametrically expanded portion 30.

The detector 34 includes an installation hole (communication passage) 38 penetrating in a radially inward direction (the direction of the arrow C shown in FIG. 3) from the outer peripheral face of the diametrically expanded portion 30, a ball (valve) 40 disposed in the installation hole 38, a plug 42 also disposed in the installation hole 38, and a spring 44 arranged so as to intervene between the ball 40 and the plug 42.

Figure 3:
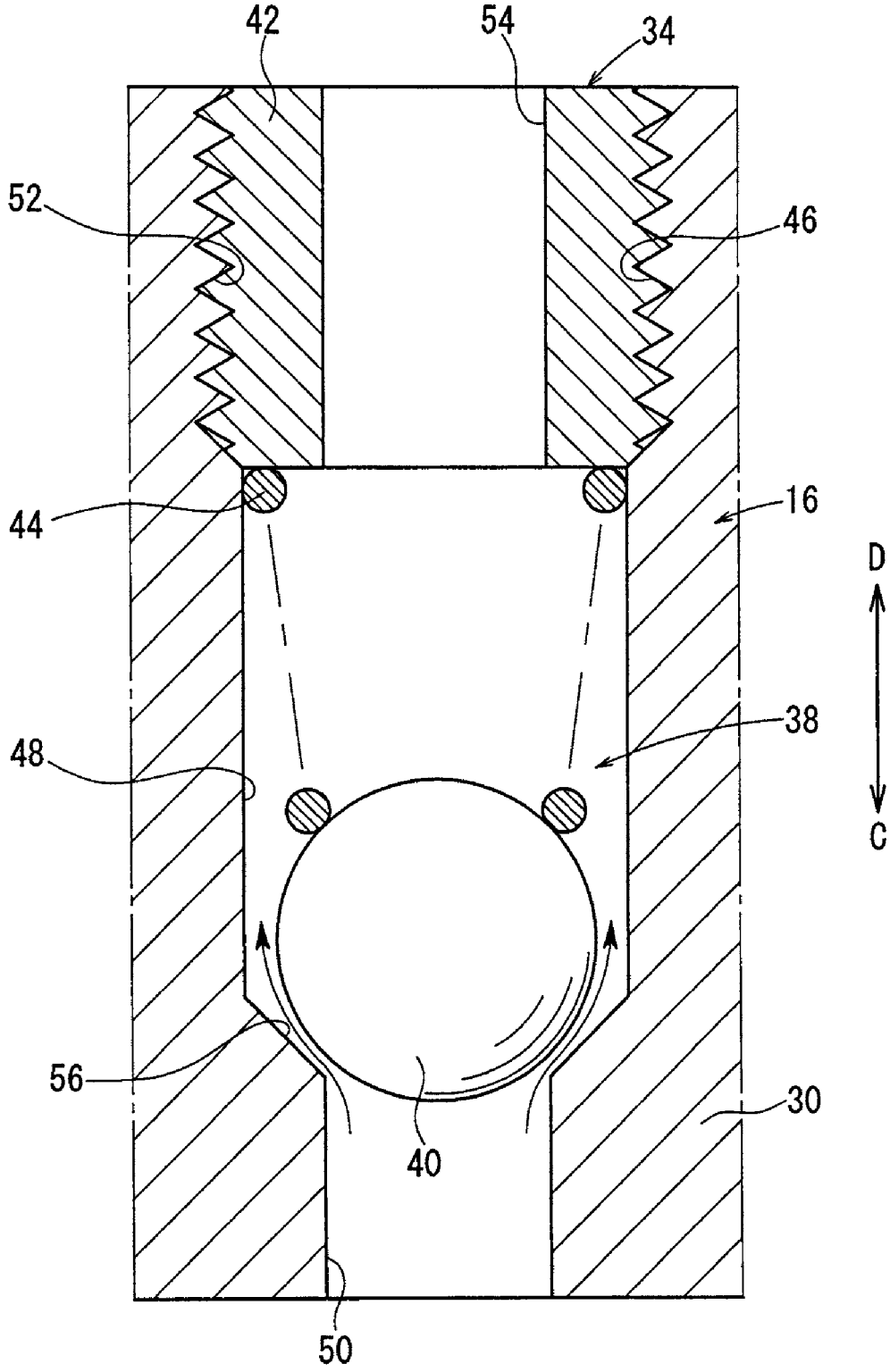
FIG. 3 is an enlarged vertical sectional view showing the vicinity of the detector portion shown in FIG. 1.

As shown in FIG. 3, the installation hole 38 is formed by a first hole 46 formed radially outwardly (in the direction of the arrow D) within the diametrically expanded portion 30, a second hole 48 formed radially inwardly (in the direction of the arrow C) from the first hole 46 and having a reduced diameter with respect to the first hole 46, and a third hole 50 formed radially inwardly (in the direction of the arrow C) from the second hole 48 and having a reduced diameter with respect to the second hole 48.

Threads 52 are engraved on the inner circumferential surface of the first hole 46, wherein the plug 42 is screw-engaged in the first hole 46 through the threads 52. A detection hole 54 is formed substantially centrally in the plug 42, penetrating therethrough along the axial direction, wherein the interior of the first hole 46 communicates with the outside through the detection hole 54.

Further, in the second hole 48, at the border position with the third hole 50, an inclined surface 56 is formed, which is gradually reduced in diameter toward the third hole 50 (in the direction of the arrow C), wherein the ball 40 is arranged so as to abut against the inclined surface 56. The diameter of the ball 40 is smaller than the inner circumference of the second hole 48, and further, is formed so as to be larger than the inner circumference of the third hole 50. More specifically, the ball 40 blocks the third hole 50 by abutment with the inclined surface 56 in the second hole 48, thereby interrupting communication between the second hole 48 and the third hole 50. At this time, the ball 40 is appropriately retained by the inclined surface 56, which is gradually reduced in diameter in a direction toward the side of the third hole 50.

Stated otherwise, the inclined surface 56 against which the ball 40 abuts functions as a valve seat by seating of the ball 40, which functions as a valve, for interrupting communication between the second hole 48 and the third hole 50.

Furthermore, a spring 44 is arranged so as to intervene between the plug 42 that blocks the first hole 46 and the ball 40. An elastic force of the spring 44 imposes a force, which presses the ball 40 against the inclined surface 56 that forms the valve seat. Specifically, the ball 40 abuts with respect to the inclined surface 56 under an elastic action of the spring 44.

Incidentally, the above-described detector 34 is not limited to the case of a single instance, but rather, a plurality of such detectors can be disposed in the diametrically expanded portion 30 of the body 16, separated from one another by predetermined distances in the circumferential direction.

Figure 2:
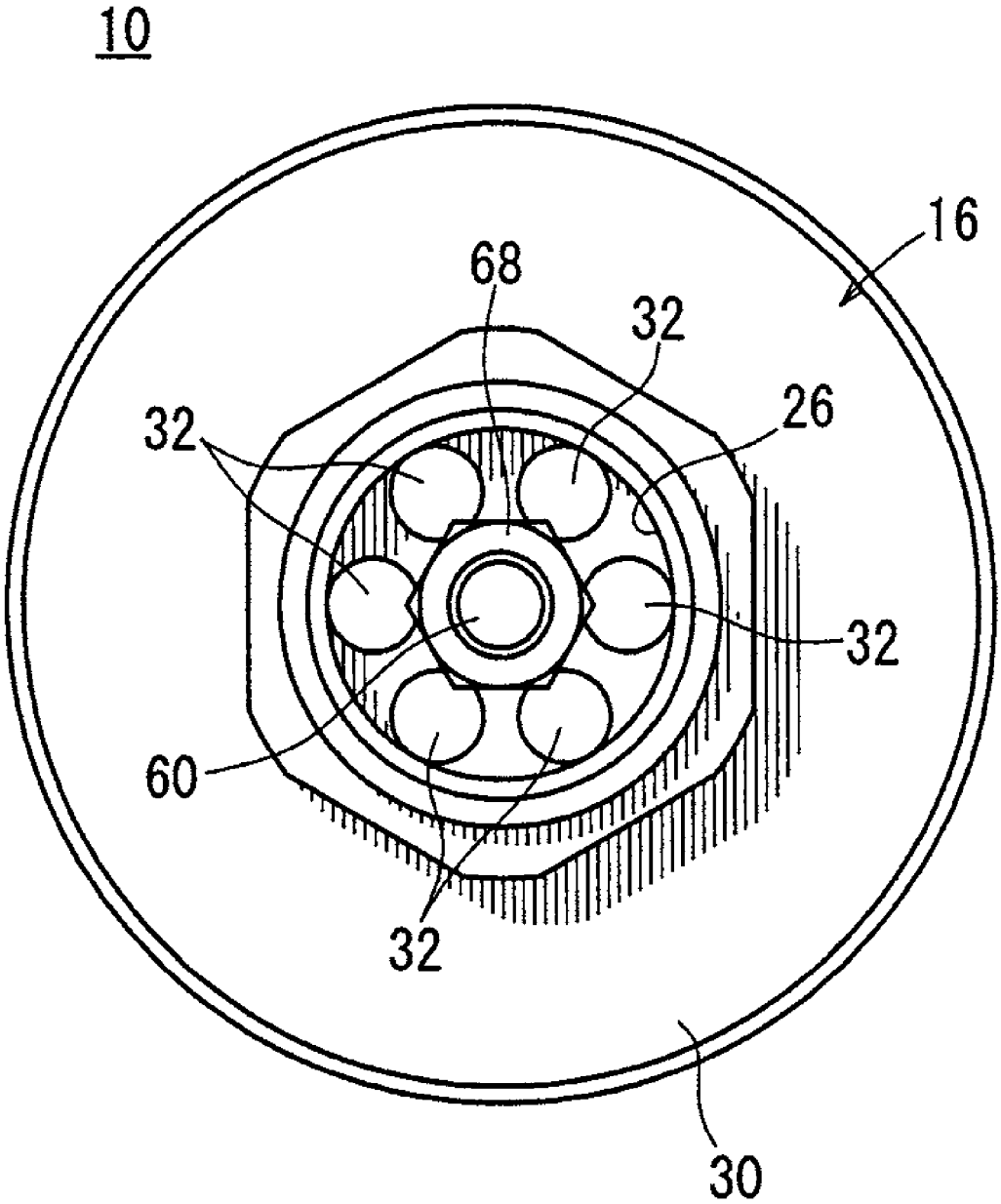
FIG. 2 is a plan side view, as seen from a side of the body of the silencer shown in FIG. 1.

On the other hand, as shown in FIG. 1, a first bolt hole 62, through which a connecting bolt 60 is inserted, is formed substantially centrally on an inner circumferential side of the diametrically expanded portion 30, together with a plurality of communication holes 32 formed radially outwardly of the first bolt hole 62. The communication holes 32 are formed substantially in parallel with the first bolt hole 62, and further, are separated at predetermined distances from each other along the circumferential direction, with the first bolt hole 62 at the center thereof (see FIG. 2). In addition, the penetrating hole 26 and the other end side of the diametrically expanded portion 30 communicate with each other through the communication holes 32. Moreover, the installation hole 38 formed in the diametrically expanded portion 30 communicates with one of the communication holes 32.

The retaining member 18 is formed in a disk shape, having substantially the same diameter as that of the diametrically expanded portion 30 of the body 16. A second projection 64, formed annularly on a circumferential portion of the retaining member 18, projects slightly toward the body 16 (in the direction of the arrow A).

Further, a second bolt hole 66 is formed substantially centrally in the retaining member 18, wherein an elongate connecting bolt 60 is inserted through the second bolt hole 66. In addition, the other end of the connecting bolt 60 is inserted through the first bolt hole 62 of the body 16, such that, in a state in which the cylindrical member 20, the sound absorber 22 and the cover member 24 are arranged between the body 16 and the retaining member 18, a nut 68 is connected by threading to the body 16. As a result, the body 16 and the retaining member 18 are integrally connected, while sandwiching the cylindrical member 20, the sound absorber 22 and the cover member 24 therebetween.

The cylindrical member 20 is arranged such that one end portion thereof abuts against an end face of the diametrically expanded portion 30, facing the communication holes 32 of the body 16, whereas the other end portion abuts against an end face of the retaining member 18. In addition, the pressure fluid is introduced to the interior of the cylindrical member 20 through the communication holes 32 of the body 16.

Further, first exhaust holes (exhaust holes) 70*a* are formed at a substantially central portion in the axial direction on the outer circumferential wall of the cylindrical member 20, and second through fifth exhaust holes (exhaust holes) 70*b*, 70*c*, 70*d*, 70*e* are formed, directed toward the retaining member 18 (in the direction of the arrow B) from the first exhaust holes 70*a*, while being separated from each other by predetermined differences. The first through fifth exhaust holes 70*a* to 70*e* are disposed so as to be separated from each other at substantially equal intervals respectively along the axial direction of the cylindrical member 20, wherein the diameters of the first through fifth exhaust holes 70*a* to 70*e* are formed to be substantially equal.

For example, the first exhaust holes 70*a* are formed at two locations, separated at a predetermined interval, circumferentially along the cylindrical member 20, the second exhaust holes 70*b* are formed at four locations circumferentially along the cylindrical member 20, the third exhaust holes 70*c* are formed at six locations circumferentially along the cylindrical member 20, the fourth exhaust holes 70*d* are formed at eight locations circumferentially along the cylindrical member 20, and the fifth exhaust holes 70*e* are formed at ten locations circumferentially along the cylindrical member 20.

Stated otherwise, the first through fifth exhaust holes 70*a* to 70*e* are disposed such that the number of exhaust holes gradually increases in quantity from one end side (in the direction of the arrow A) of the cylindrical member 20 into which the pressure fluid is introduced toward the other end side (in the direction of the arrow B) formed by the retaining member 18. Owing thereto, when the pressure fluid flows to the outside from the interior of the cylindrical member 20 via the first through fifth exhaust holes 70*a* to 70*e*, the passage area can gradually be increased.

Incidentally, the quantities of the first through fifth exhaust holes 70*a* to 70*e* are not limited to the quantities described above, insofar as they are set such that the holes gradually increase in quantity, from a substantially central portion of the cylindrical member 20 toward the retaining member 18, and such that the passage area of the pressure fluid flowing to the outside from the interior of the cylindrical member 20 gradually increases.

Further, it is acceptable if the quantities of the first to fifth exhaust holes 70*a* to 70*e* are made substantially the same, but wherein the diameters thereof are caused to gradually increase from the first exhaust hole 70*a* toward the fifth exhaust hole 70*e*. It is also acceptable if the interval of separation along the axial direction of the first through fifth exhaust holes 70*a* to 70*e* is made gradually smaller. In other words, concerning the shapes and number of the first through fifth exhaust holes 70*a* to 70*e* in the cylindrical member 20, it is acceptable merely if the passage area thereof is set such that the flow rate of the pressure fluid flowing through the first through fifth exhaust holes 70*a* to 70*e* gradually increases from one end side of the cylindrical member 20 toward the other end side thereof, whereas the specific quantities and shapes of the holes are not particularly limited.

The sound absorber 22 is formed in a mesh shape from a resin material that is capable of reducing exhaust sounds of the pressure fluid, and more particularly, is formed by weaving a fibrous resin material. The sound absorber 22 is arranged between the diametrically expanded portion 30 of the body 16 and the end face of the retaining member 18, and further is arranged so as to be separated a predetermined distance in the radial direction (the direction of the arrow D) from the outer circumferential surface of the cylindrical member 20. In other words, a clearance (space) providing a predetermined interval separation is formed between the sound absorber 22 and the cylindrical member 20.

The sound absorber 22 is constructed from a first filter 80 arranged on the outer circumference of the cylindrical member 20, a second filter 82 arranged over the outer circumference of the first filter 80 and formed with an opening diameter (opening area) mesh size smaller than that of the first filter 80, and a third filter 84 arranged over the outer circumference of the second filter 82 and formed with an opening diameter mesh size smaller than that of the second filter 82.

Stated otherwise, in the sound absorber 22, the first through third filters 80, 82, 84 are formed in order such that the mesh size opening diameters thereof become gradually smaller, and further, wherein the first through third filters 80, 82, 84 are formed in three layers. In addition, the first through third filters 80, 82, 84 are each formed with substantially the same radial thickness, respectively.

Incidentally, the sound absorber 22 is not limited to the case of being formed in a three-layer structure from first through third filters 80, 82, 84, insofar as plural filters having different opening diameter mesh sizes are stacked, and wherein the filters are arranged such that in the sound absorber 22 the opening diameters become smaller in order from a radially inward direction toward a radially outward direction thereof.

The cover member 24 is formed in a cylindrical shape from a metallic material, wherein plural holes 86 are formed, separated by predetermined distances, in axial and circumferential directions on the outer circumferential surface of the cover member 24. The holes 86 operate to discharge the pressure fluid output from the first through fifth exhaust holes 70*a* to 70*e* of the cylindrical member 20 to the outside through the sound absorber 22.

In addition, through engagement of the first projection 36 of the body 16 and the second projection 64 of the retaining member 18 with the outer circumferential surface of the cover member 24, displacement of the cover member 24 in the radial direction (the direction of arrows C and D) is regulated. Accordingly, radial displacement of the sound absorber 22 arranged inside the cover member 24 similarly does not occur.

The silencer 10 according to the first embodiment of the present invention is basically constructed as described above. Next, operations, functions and effects of the silencer 10 shall be described. In the following description, an explanation shall be given concerning a case in which the connecting portion 28 of the body 16 is directly connected to the exhaust port 14 of a fluid pressure device 12.

First, pressure fluid is introduced from the exhaust port 14 of the fluid pressure device 12 into the penetrating hole 26 of the body 16, which is connected to the exhaust port 14.

Additionally, the pressure fluid, which is introduced to the interior of the cylindrical member 20, is directed to the outside from the cylindrical member 20 through the first through fifth exhaust holes 70*a* to 70*e* of the cylindrical member 20. At this time, because the first through fifth exhaust holes 70*a* to 70*e* are formed such that their quantity becomes gradually greater in a direction (the direction of the arrow B) toward the other end of the cylindrical member 20, the discharged amount (flow amount) of the pressure fluid gradually increases in a direction toward the other end side of the cylindrical member 20 formed by the retaining member 18 (in direction of the arrow B).

More specifically, because the pressure fluid, which is directed into the cylindrical member 20 from the fluid pressure device 12 through the connecting portion 28, is gradually exhausted to the exterior of the cylindrical member 20 via the first through fifth exhaust holes 70*a* to 70*e*, the pressure of the pressure fluid does not drop precipitously, but rather, the pressure thereof can be gradually lowered. As a result, lowering in temperature due to adiabatic expansion of the pressure fluid can be suppressed, so that condensation generated inside silencer 10 caused by such a temperature drop can be prevented, together with preventing freezing of such condensation inside the silencer 10.

Next, the pressure fluid discharged from the cylindrical member 20 is exhausted to the outside through the holes 86 of the cover member 24 while passing in order through the first filter 80, the second filter 82 and the third filter 84 of the sound absorber 22. At this time, concerning the first through third filters 80, 82 and 84, since they are formed such that the opening diameters of the meshes thereof become gradually smaller in order from the first to third filters 80, 82 and 84, dust and the like contained within the pressure fluid is removed by any one of the filters 80, 82, 84 depending on the size thereof.

Specifically, large sized dust is complemented and removed by the first filter 80 having a large opening diameter mesh, which is disposed on the inner circumferential side of the sound absorber 22 on the side of the cylindrical member 20, and dust smaller than the opening diameter of the first filter 80 is complemented and removed by the second filter 82 after passing through the first filter 80, and further, dust smaller than the opening diameter of the second filter 82 is complemented and removed appropriately by the third filter 84 after having passed through the first and second filters 80, 82.

In this manner, as a result of providing plural filters made up of first to third filters 80, 82, 84 having different mesh opening diameters in the sound absorber 22, corresponding to the sizes of the dust contained within the pressure fluid, the dust removal filter can be used while being responsive to different dust sizes. As a result, compared with a sound absorber 22 formed from only one mesh opening diameter, the occurrence of clogging in the sound absorber 22 can be suppressed.

On the other hand, when clogging occurs in the sound absorber 22 for one reason or another, the pressure in the cylindrical member 20 and body 16 on the upstream side of the sound absorber 22 increases. In this case, as a result of the rise in pressure in the body 16, a pressing force is imposed in a radially outward direction (the direction of the arrow D) with respect to the ball 40 of the detector 34, wherein the ball 40 is displaced so as to separate away from the inclined surface 56 in opposition to the elastic force of the spring 44.

As a result, the communication interrupted state between the second hole 48 and the third hole 50, which is interrupted by the ball 40, is cancelled, whereupon the pressure fluid flows toward the second hole 48 owing to a small gap formed between the ball 40 and the inclined surface 56, and is directed outwardly through the first hole 46 and the detection hole 54 (see FIG. 3). Further, in this case, because of the small gap formed between the outer circumferential surface of the ball 40 and the inclined surface 56, and since the third hole 50 is formed with a smaller diameter than the second hole 48 and functions to restrict flow, a high-pitched passing noise is generated when the pressure fluid, at a high pressure, flows through the gap.

As a result, when the pressure inside the silencer 10 rises to a predetermined value or above, because a high-pitched passing noise is generated in the detector 34, for example, an operator, by confirmation of such a passing noise, can easily confirm an improper operation or malfunctioning of the silencer 10.

Further, since the pressure fluid passes through the detector 34 and can be discharged to the outside, further rising of pressure inside the silencer 10 can be prevented. In other words, the detector 34 functions as a relief valve, which is capable of discharging the pressure fluid inside the silencer.

More specifically, because the pressure value resulting when malfunctioning of the silencer 10 is detected is set by the elastic force of the spring 44, in the case that the detected pressure value is to be set higher, a spring 44 having a larger elastic force may be employed. Conversely, in the case that the detected pressure value is to be set lower, a spring 44 having a smaller elastic force may be employed. In this manner, by suitably employing a spring 44 possessing an elastic force that acts to resist the pressure (pressing force) of the pressure fluid, the value at which pressure inside the silencer 10 is detected can freely be set.

Moreover, the detector 34 should be disposed at a position (for example, in the diametrically expanded portion 30 of the body 16) at which the generation of condensation by adiabatic expansion when the pressure fluid is discharged to the outside is difficult.

Further, in the case that clogging in the sound absorber 22 is confirmed, dust and the like may be removed either by replacing the sound absorber 22 or by cleaning the sound absorber 22.

As described above, according to the first embodiment, in the cylindrical member 20 to which the pressure fluid is introduced, first through fifth exhaust holes 70*a* to 70*e* are formed for the purpose of discharging the pressure fluid to the outside, wherein the first exhaust holes 70*a* are separated a predetermined distance away from the body 16, and the second through fifth exhaust holes 70*b* to 70*e* are formed so as to be separated by predetermined distances from the first exhaust hole 70*a* toward the side of the retaining member 18 (in the direction of the arrow B). Further, the quantity of the holes increases, in a staged manner, from the first exhaust holes 70*a* formed on the side of the body 16 toward the fifth exhaust holes 70*e* formed on the side of the retaining member 18.

Accordingly, the pressure fluid that is introduced into the cylindrical member 20 from the body 16 is exhausted gradually to the outside through the first to fifth exhaust holes 70*a* to 70*e*, and therefore, a precipitous lowering in pressure of the pressure fluid can be prevented. As a result, lowering in temperature of the pressure fluid inside the silencer 10 by adiabatic expansion can be controlled, and hence condensation within the body 16 and the interior of the cylindrical member 20 can be prevented, along with preventing freezing of generated condensation at low temperatures.

Further, the sound absorber 22 is disposed on and outer circumferential side thereof surrounding the cylindrical member 20, with the sound absorber 22 being constructed from stacked mesh-shaped first through third filters 80, 82, 84, and wherein the mesh opening diameters thereof are set so as to become gradually smaller in order from the first to the third filters 80, 82 and 84. As a result, when the pressure fluid is discharged from the cylindrical member 20 to the outside through the sound absorber 22, corresponding to the sizes of the dust contained within the pressure fluid, since the dust can be removed by one of the filters 80, 82 or 84, compared with a sound absorber formed from only one mesh opening diameter, the occurrence of clogging in the sound absorber 22 can be suppressed.

Moreover, by disposing the detector 34 in the diametrically expanded portion 30 of the body 16, when a pressure malfunction arises in the silencer 10 due to one reason or another, the ball 40 separates away from the inclined surface 56 of the second hole 48 by the pressure (pressing force) of the pressure fluid, and when the pressure fluid flows between the ball 40 and the inclined surface 56, a high-pitched passing noise can be generated. Owing thereto, for example, an operator can easily confirm an improper operation or malfunctioning of the silencer 10 by confirmation of such a passing noise.

Figure 4:
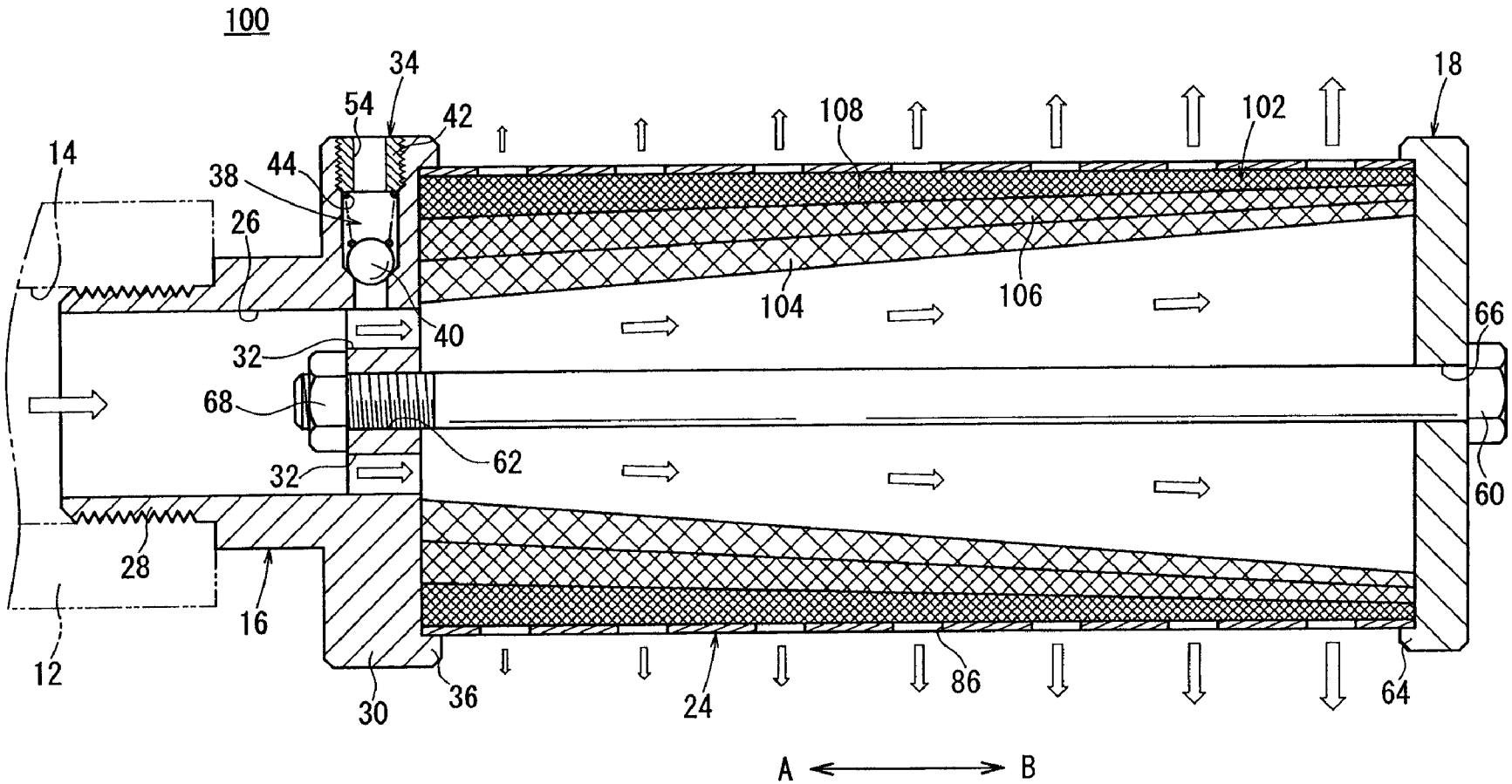
FIG. 4 is a vertical sectional view of a silencer according to a second embodiment of the present invention.

Next, a silencer 100 according to a second embodiment is shown in FIG. 4. Structural elements, which are the same as those of the above-described silencer 10 in accordance with the first embodiment of the present invention, are designated using the same reference numerals, and detailed explanations thereof shall be omitted.

The silencer 100 according to the second embodiment differs from the silencer 10 of the first embodiment in that the inner circumferential surface of the sound absorber 102, arranged between the body 16 and the retaining member 18, is formed so as to expand gradually in diameter from the body 16 toward the retaining member 18.

The sound absorber 102, as shown in FIG. 4, includes a radially inwardly disposed first filter 104, a second filter 106 arranged over the outer circumference of the first filter 104 and formed with an opening diameter mesh size smaller than that of the first filter 104, and a third filter 108 arranged over the outer circumference of the second filter 106 and formed with an opening diameter mesh size smaller than that of the second filter 106.

The first filter 104 is formed such that the inner circumferential diameter and outer circumferential diameter thereof gradually are expanded in diameter from the body 16 toward the retaining member 18 (in the direction of the arrow B), and further, such that the thickness of the first filter 104 in the radial direction is formed so as to become gradually thinner toward the retaining member 18 (in the direction of the arrow B).

The second filter 106, similarly, is formed such that the inner circumferential diameter and outer circumferential diameter thereof gradually are expanded in diameter from the body 16 toward the retaining member 18 (in the direction of the arrow B), and further, such that the thickness of the second filter 106 in the radial direction is formed so as to become gradually thinner toward the retaining member 18 (in the direction of the arrow B). In addition, the inner circumferential surface of the second filter 106 abuts against the outer circumferential surface of the first filter 104.

The third filter 108 is formed with a substantially constant outer circumferential diameter, wherein the inner circumferential diameter thereof gradually expands in diameter from the body 16 toward the retaining member 18 (in the direction of the arrow B). In addition, the inner circumferential surface of the third filter 108 abuts against the outer circumferential surface of the second filter 106.

In this manner, the sound absorber 102 is formed in three layers, from first to third filters 104, 106 and 108, having different mesh opening diameters, and in addition, the filters are formed so as to become gradually expanded in diameter and thinner, from the body 16 toward the retaining member 18 (in the direction of the arrow B).

In this manner, in the silencer 100 according to the second embodiment, the first to third filters 104, 106 and 108 provided in the sound absorber 102 are formed so as to become gradually increased in diameter and thinner from the body 16 toward the retaining member 18 (in the direction of the arrow B). As a result, when the pressure fluid that is introduced from the body 16 passes through the sound absorber 102 and is discharged to the outside, because the pressure fluid is more easily discharged at the side of the retaining member 18 as opposed to the side of the body 16, the discharged amount (flow amount) of the pressure fluid that is discharged externally through the sound absorber 102 can be made to increase gradually from the side of the body 16 (in the direction of the arrow A) toward the side of the retaining member 18 (in the direction of the arrow B).

In other words, as a result of forming the first through third filters 104, 106 and 108 such that they become gradually increased in diameter and thinner from the body 16 toward the retaining member 18, when the pressure fluid is discharged to the outside, the passage area through which the pressure fluid flows can be made to gradually increase.

As a result thereof, a sudden and rapid decrease in pressure when the pressure fluid is discharged can be prevented, and since the temperature decrease caused by adiabatic expansion of the pressure fluid in the silencer 100 can be controlled, it becomes possible to prevent generation of condensation in the interior of the silencer 100.

As a result, in the silencer 100 according to the second embodiment, the cylindrical member 20 disposed in the silencer 10 in accordance with the first embodiment becomes unnecessary. Therefore, the number of parts making up the silencer 100 can be reduced, together with enabling a reduction in the number of construction processes when the silencer 100 is assembled.

Further, since it is unnecessary to provide the cylindrical member 20 (see FIG. 1) inside the sound absorber 102, the silencer 100 can be made lighter in weight overall.

INDUSTRIAL APPLICABILITY

As described above, according to the present invention, in the pressure fluid introduced into the main body portion from the fluid pressure device, the flow rate at which the pressure fluid is exhausted to the outside can gradually be increased by the flow adjustment mechanism. As a result, when the pressure fluid is exhausted to the outside from the fluid pressure device, temperature reduction due to adiabatic expansion can be suppressed, and it is possible to prevent condensation from occurring in the interior of the silencer, and in addition, freezing of the generated condensation at low temperatures can be prevented.

Further, since the sound absorber is constructed by stacking a plurality of filters having different opening areas, corresponding to the sizes of dust contained within the pressure fluid, the dust can be removed by one of the plural filters when the pressure fluid is exhausted to the outside through the sound absorber. As a result, compared with a sound absorber formed with only one opening area, the occurrence of clogging in the sound absorber can suppressed.

The invention claimed is:

1. A silencer for causing a reduction in exhaust noises of a pressure fluid exhausted from a fluid pressure device, comprising:

a main body portion to which said fluid pressure device is connected and to which a pressure fluid from said fluid pressure device is introduced;

a sound absorber retained within said main body portion and formed from filters made up of plural stacked layers having different opening areas;

a disk shaped retaining member disposed coaxially with and separated a predetermined interval away from said main body portion, said sound absorber being sandwiched between said main body portion and said retaining member, said retaining member preventing said pressure fluid from flowing in an axial direction outside of said silencer, and forcing said pressure fluid to flow in a radial direction through said filters of said sound absorber and outside of said silencer; and a flow adjustment mechanism for gradually increasing a flow amount of the pressure fluid that flows in said radial direction and is exhausted to the outside from said main body portion through said sound absorber in a direction separating away from said fluid pressure device, said flow adjustment mechanism comprising a central core through which said pressure fluid flows in said axial direction, said central core extending in said axial direction and being disposed radially inward of all of said plural stacked layers that make up said filters, said retaining member sealing an end of said central core;

wherein the opening areas of said filters are set so as to become gradually smaller directed from an upstream side formed at a side of said main body portion toward a downstream side formed at an exterior side of said sound absorber.

2. The silencer according to claim 1, wherein said flow adjustment mechanism preferably includes a fluid passage for enabling a pressure fluid to flow from said main body portion to the exterior of said sound absorber, and wherein a passage area of said fluid passage is formed so as to become gradually larger in a direction separating away from said fluid pressure device.

3. The silencer according to claim 2, wherein said fluid passage is formed from a cylindrical body disposed inside said sound absorber and communicating with said main body portion, having a plurality of exhaust holes that become gradually greater in quantity in a direction separating away from the fluid pressure device.

4. The silencer according to claim 3, wherein a clearance is disposed between said cylindrical body and said sound absorber.

5. The silencer according to claim 4, wherein said filters are constructed from three layers, which are stacked radially.

6. The silencer according to claim 5, wherein said filters have respective thickness dimensions in the radial direction that are substantially uniform.

7. The silencer according to claim 6, wherein a cylindrical cover member surrounding said sound absorber is connected to said main body portion, wherein said cover member has holes therein through which said pressure fluid that flows through the sound absorber also flows.

8. The silencer according to claim 2, wherein said flow adjustment mechanism comprises filters disposed radially outside of said central core and having thickness dimensions becoming gradually smaller in a direction separating away from said fluid pressure device.

9. The silencer according to claim 1, wherein a detection mechanism is disposed in said main body portion for detecting a case in which the pressure of said pressure fluid inside said main body portion rises to a predetermined value or above.

10. The silencer according to claim 9, wherein said detection mechanism comprises:

a communication passage disposed in said main body portion communicating the interior of the main body portion with the outside;

a valve seated on a valve seat formed in said communication passage; and a spring for pressing said valve toward said valve seat.

* * * * *

UNITED STATES PATENT AND TRADEMARK OFFICE

CERTIFICATE OF CORRECTION

PATENT NO. : 7,753,167 B2
APPLICATION NO. : 11/813277
DATED : July 13, 2010
INVENTOR(S) : Yoshihiro Fukano et al.

It is certified that error appears in the above-identified patent and that said Letters Patent is hereby corrected as shown below:

On the Title Page, Item (86) The PCT No., "PCT/JP2006/000310", should be changed to --PCT/JP2006/300310--.

Signed and Sealed this
Fourth Day of January, 2011

David J. Kappos

David J. Kappos
*Director of the United States Patent and Trademark Office*